US007320407B2

(12) United States Patent
Hubbs et al.

(10) Patent No.: US 7,320,407 B2
(45) Date of Patent: Jan. 22, 2008

(54) PRODUCT DISPLAY AND SUPPORT CARTON

(75) Inventors: William Hubbs, Barrington, IL (US); Christopher Galardi, Gurnee, IL (US)

(73) Assignee: Walgreen Co., Deerfield, IL (US)

( * ) Notice: Subject to any disclaimer, the term of this patent is extended or adjusted under 35 U.S.C. 154(b) by 266 days.

(21) Appl. No.: 11/295,112

(22) Filed: Dec. 6, 2005

(65) Prior Publication Data

US 2006/0138020 A1 Jun. 29, 2006

Related U.S. Application Data

(63) Continuation-in-part of application No. 10/684,700, filed on Oct. 14, 2003, now Pat. No. 7,000,773.

(51) Int. Cl.
*B65D 5/50* (2006.01)
*B65D 25/04* (2006.01)

(52) U.S. Cl. ..... 206/764; 206/745; 229/120.18; 229/120.24; 229/120.38; 229/164; 229/191

(58) Field of Classification Search ..... 206/736, 206/738–739, 745, 756, 762–766, 769, 425, 206/485, 526, 45.29; 229/120.18–120.19, 229/120.24, 120.26, 120.27, 120.38, 164, 229/191, 242
See application file for complete search history.

(56) References Cited

U.S. PATENT DOCUMENTS 476,765 A 6/1892 Knapp
1,909,473 A * 5/1933 Keppler ..... 206/762
2,260,428 A * 10/1941 Barr et al. ..... 206/762
3,208,583 A * 9/1965 Kamps ..... 206/562
3,258,114 A * 6/1966 King ..... 206/738
3,669,251 A * 6/1972 Phillips, Jr. ..... 206/756
3,756,385 A * 9/1973 Steinbock ..... 206/526
3,955,671 A * 5/1976 Ockey ..... 206/562
4,363,405 A 12/1982 Christie
4,566,607 A 1/1986 Smith
5,038,946 A 8/1991 Tenser et al.
5,167,324 A 12/1992 Miller
5,344,027 A 9/1994 Kaplan
5,372,299 A * 12/1994 Edgerton et al. ..... 229/120.18
5,464,149 A * 11/1995 Fowler et al. ..... 229/120.27
5,505,371 A * 4/1996 O'Neill ..... 229/120.26
5,950,911 A * 9/1999 Naughton et al. ..... 229/120.18
6,135,289 A 10/2000 Miller
6,405,869 B1 * 6/2002 Whittemore et al. ..... 206/497
6,676,012 B1 * 1/2004 Southwell et al. ..... 229/120.18

* cited by examiner

*Primary Examiner*—Bryon P Gehman
(74) *Attorney, Agent, or Firm*—Marshall, Gerstein & Borun LLP

(57) ABSTRACT

In order to facilitate the display and support of a product such as a gift bag for selection and purchase by a consumer, a product display and support carton includes a display box and an opposed pair of dividers. The display box is defined by a bottom panel and an upwardly extending wall panel which together form a product carrying enclosure. The display box has an open top defined by a top wall panel edge disposed opposite the bottom panel. An opposed pair of dividers extends upwardly from opposite sides of the wall panel into the product carrying enclosure toward one another to define a plurality of product receiving compartments. At least one of the receiving compartments is generally wider near the top wall panel edge than near the bottom panel.

26 Claims, 10 Drawing Sheets

PRODUCT DISPLAY AND SUPPORT CARTON

RELATED APPLICATIONS

This application is a continuation-in-part of U.S. patent application Ser. No. 10/684,700, filed on Oct. 14, 2003, now U.S. Pat. No. 7,000,773 the entirety of which is hereby incorporated by reference.

BACKGROUND

1. Field of the Invention

The present invention is generally directed to product cartons and, more particularly, to a carton that transports, displays, and supports a product.

2. Description of the Related Art

For many products, a carton is used to display and support a product that has been shipped from the point of manufacture to the destination where it will be sold. This is especially true of many smaller products that are suitable for display, but not self supporting, in a relatively large quantity within a single carton. Typically, when the carton arrives at the sales destination, the products are either already in the carton or are placed in the carton on a shelf for selection and purchase by a consumer.

As is known, there are a number of problems that are inherent in the display of some products in this particular manner. This is especially true of gift bags and the like which are preferably displayed in a relatively vertical orientation but are sufficiently thin and flexible so as not to be self-supporting. In the case of gift bags, it is not uncommon for them to be displayed by hanging them by their handles on pegs.

While hanging gift bags by their handles on pegs serves to display the gift bags in a manner where they can be seen by the consumer, there are several problems which are presented. First, the layout of the store may be such that it may not be desirable to utilize the pegs for display of gift bags. Second, the display of gift bags on pegs makes it difficult for the consumer to remove a desired one of them from the free end of the peg. Third, the gift bags may be earmarked for display on a shelf that will make it impossible to place them on a peg. Fourth, the gift bags cannot simply be placed in a carton because there is nothing to maintain them in any kind of organized manner within the carton. As bags are removed from the carton, the gift bags have a tendency to fall forward out of the display or otherwise become unsightly as they slip down into the carton due to the absence of self support.

For all of these and other reasons, there has been a need for a product display and support carton that can serve to properly display any product that is not self-supporting such as the previously mentioned gift bags.

SUMMARY

Accordingly, the present disclosure is directed to a product display and support carton that includes a display box and an opposed pair of dividers that define at least two separate product receiving compartments. The display box is formed of a bottom panel and an upwardly extending wall panel, which together form a product carrying enclosure. In addition, the display box has an open top defined by a top wall panel edge disposed opposite the bottom panel.

With this arrangement, the opposed pair of dividers extends inwardly from opposite sides of the wall panel into the product carrying enclosure toward one another to define the at least two separate product receiving compartments. At least one of the product receiving compartments being generally wider near the top wall panel edge than near the bottom panel.

In other respects, the upwardly extending wall panel is preferably defined by an upwardly extending front wall, an upwardly extending rear wall, and a pair of generally parallel side walls. The front wall advantageously comprises a product restraining wall of less than the height of the products to be displayed within the product receiving compartments of the product carrying enclosure whereas the rear wall advantageously comprises a product support panel of at least the height of the products to be displayed within the product receiving compartments. Further, the side walls are preferably vertical when the bottom panel is on a horizontal surface and the top wall panel edge of the side walls inclines upwardly and rearwardly from the front to the rear wall.

In one embodiment, the dividers define upwardly and generally rearwardly inclined product receiving compartments within the product carrying enclosure. More specifically, the carton advantageously includes a carton insert associated with each of the side walls to form and support one of the pair of dividers to define the at least two product receiving compartments.

In still other respects, the carton preferably includes a plurality of carton inserts integrally associated with each of the side walls with each of the carton inserts having at least one divider corresponding to a divider on the other one of the side walls. The carton inserts may be formed so as to be generally U-shaped or they may be formed to be generally L-shaped. In either case, the carton inserts are integrally associated with the corresponding side wall of the display box in any suitable manner which may, by way of example be accomplished by adhesively securing them to the corresponding side wall, preferably with double-sided tape.

In one embodiment, each of the carton inserts is of a height greater than the height of the product restraining rail of the front wall and of a height less than the height of the product support panel of the rear wall, i.e., of a height intermediate the height of the front and rear walls. Preferably, the display box and the carton inserts are both formed of a corrugated material and the display box may advantageously include printed indicium which is suitable information related to purchasing the products contained within the product carrying enclosure.

Other objects, advantages and features of the present invention will become apparent from a consideration of the following specification taken in conjunction with the accompanying drawings.

DETAILED DESCRIPTION OF THE PREFERRED EMBODIMENT

Figure 1:
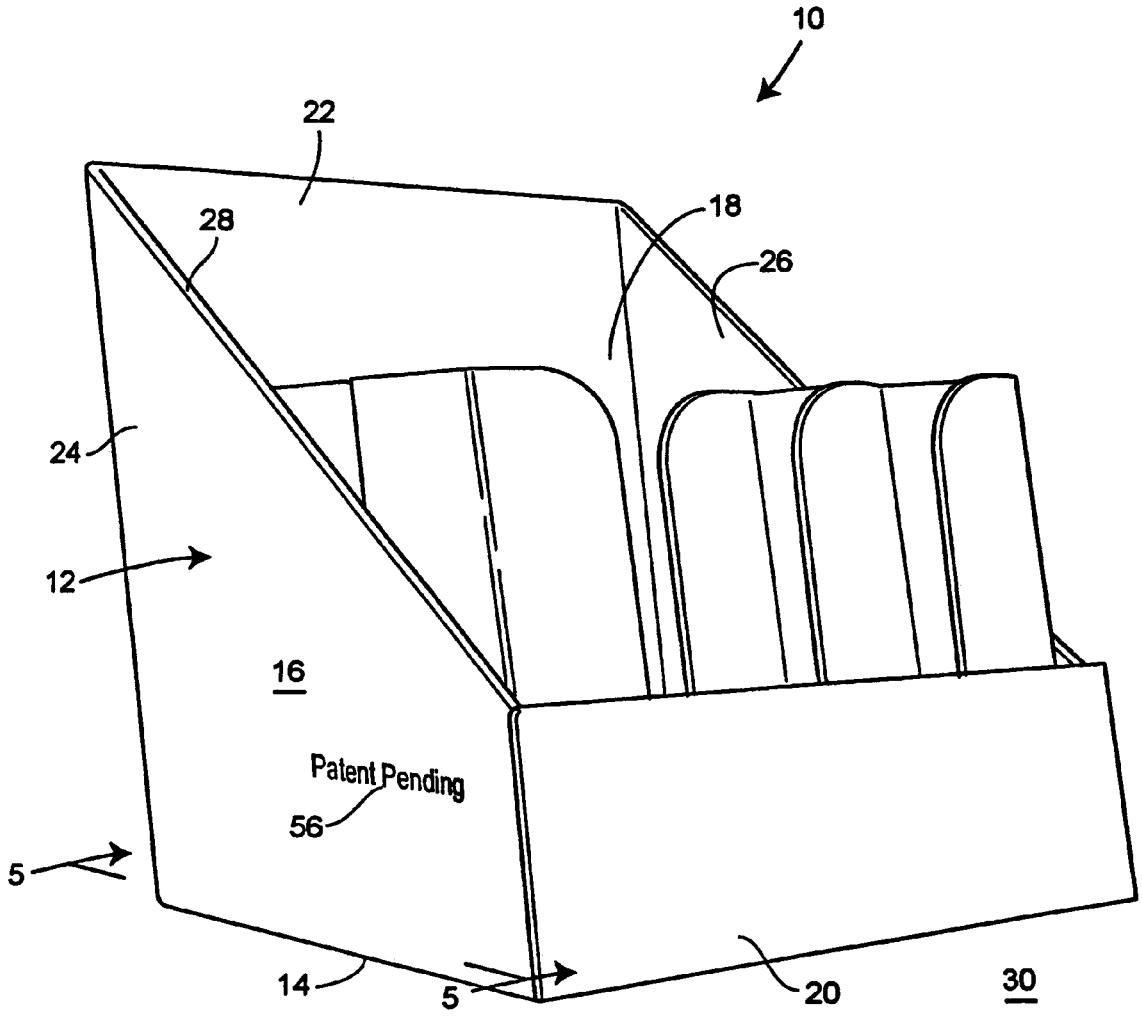
FIG. 1 is a perspective view of an exemplary product display and support carton.
Figure 3:
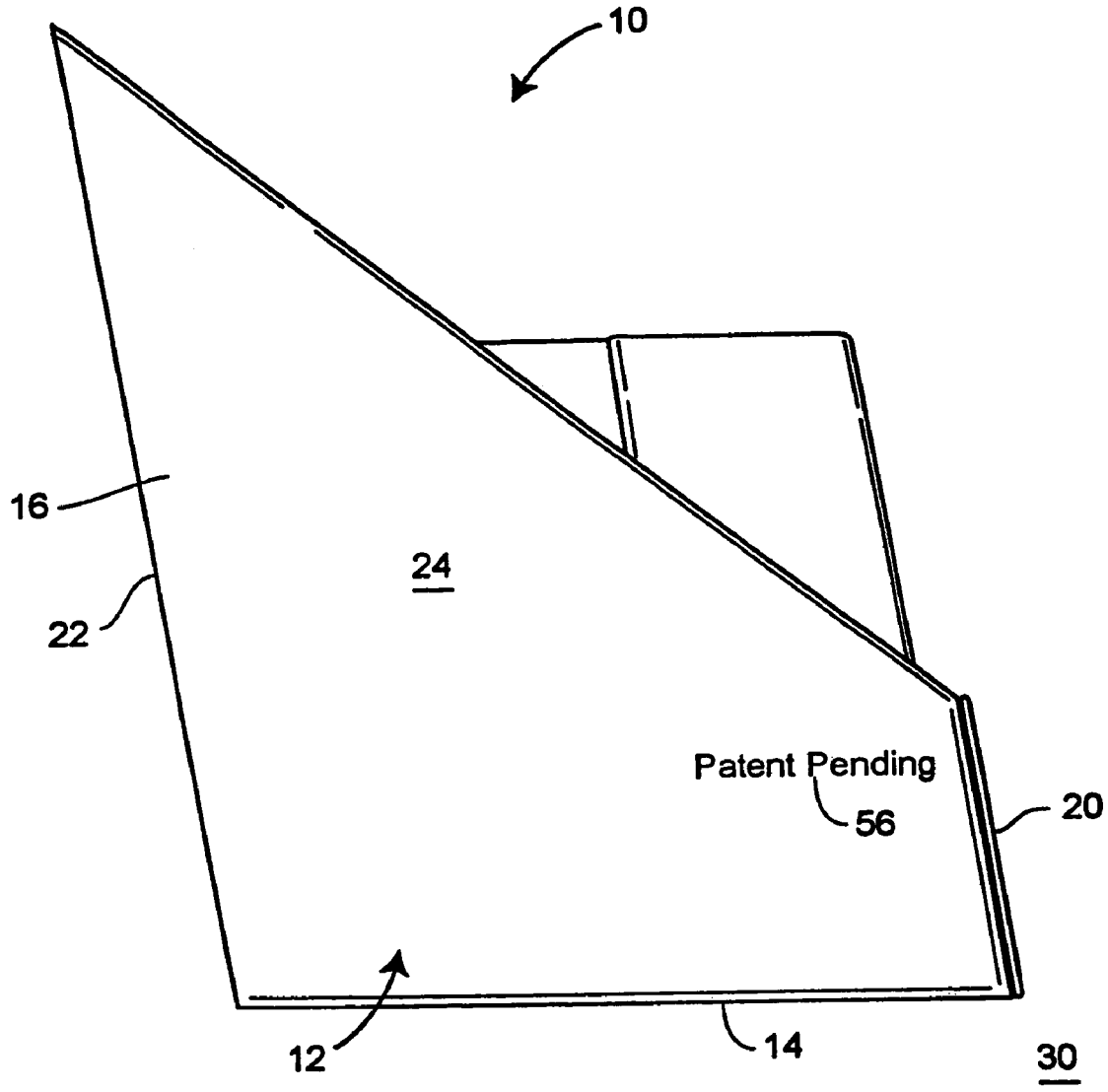
FIG. 3 is a side elevational view of the product display and support carton as illustrated in FIG. 1.

In the illustrations given, and with reference first to FIG. 1, the reference numeral 10 designates generally an exemplary product display and support carton. The carton 10 includes a display box generally designated 12 defined by a bottom panel 14 and an upwardly extending wall panel 16 which together form a product carrying enclosure 18. The upwardly extending wall 16 is defined by an upwardly and rearwardly inclined front wall 20, an upwardly and rearwardly inclined rear wall 22, and a pair of generally parallel side walls 24 and 26. The display box 12 has an open top defined by a top wall panel edge 28 of the front wall 20, rear wall 22, and side walls 24 and 26 which is located generally opposite the bottom panel 14. The product carrying enclosure 18 will be understood to be inclined at an angle to the vertical when the bottom panel is placed on a horizontal surface such as 30 (see, also FIG. 3). The carton 10 also includes a carton insert such as 32 and 34 in the product carrying enclosure 18 integrally associated with each of the side walls 24 and 26 (see, also, FIG. 4). As will be appreciated from FIG. 4, the inserts 32 and 34 form and support one of a pair of opposed dividers such as 32*a* and 34*a* extending inwardly into the product carrying enclosure 18.

Figure 4:
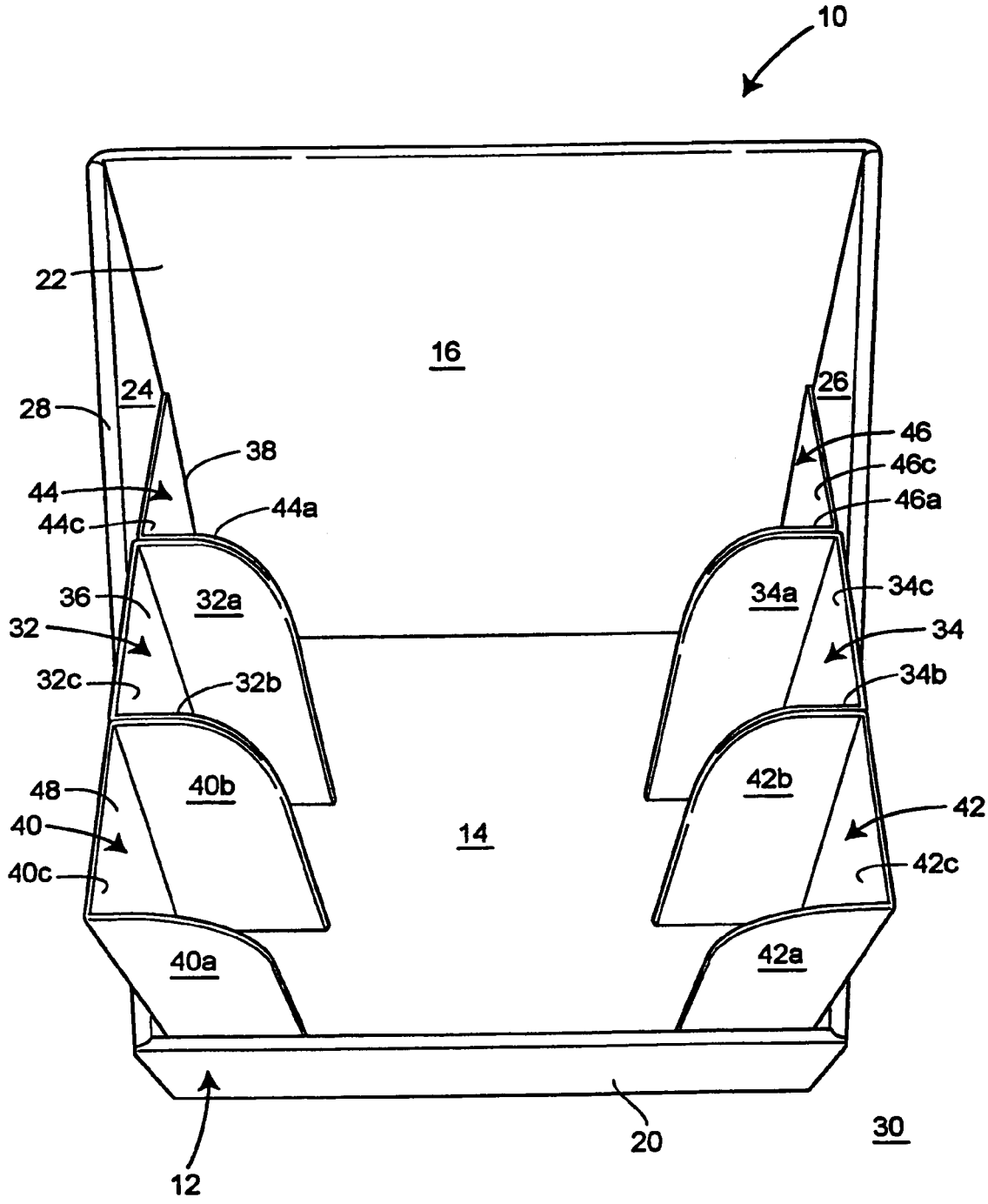
FIG. 4 is a top perspective view of the product display and support carton as illustrated in FIG. 1.

With reference still to FIG. 4, it will be seen that the inserts 32 and 34 with their dividers 32*a* and 34*a* define at least two separate product receiving compartments such as 36 and 38.

Figure 2:
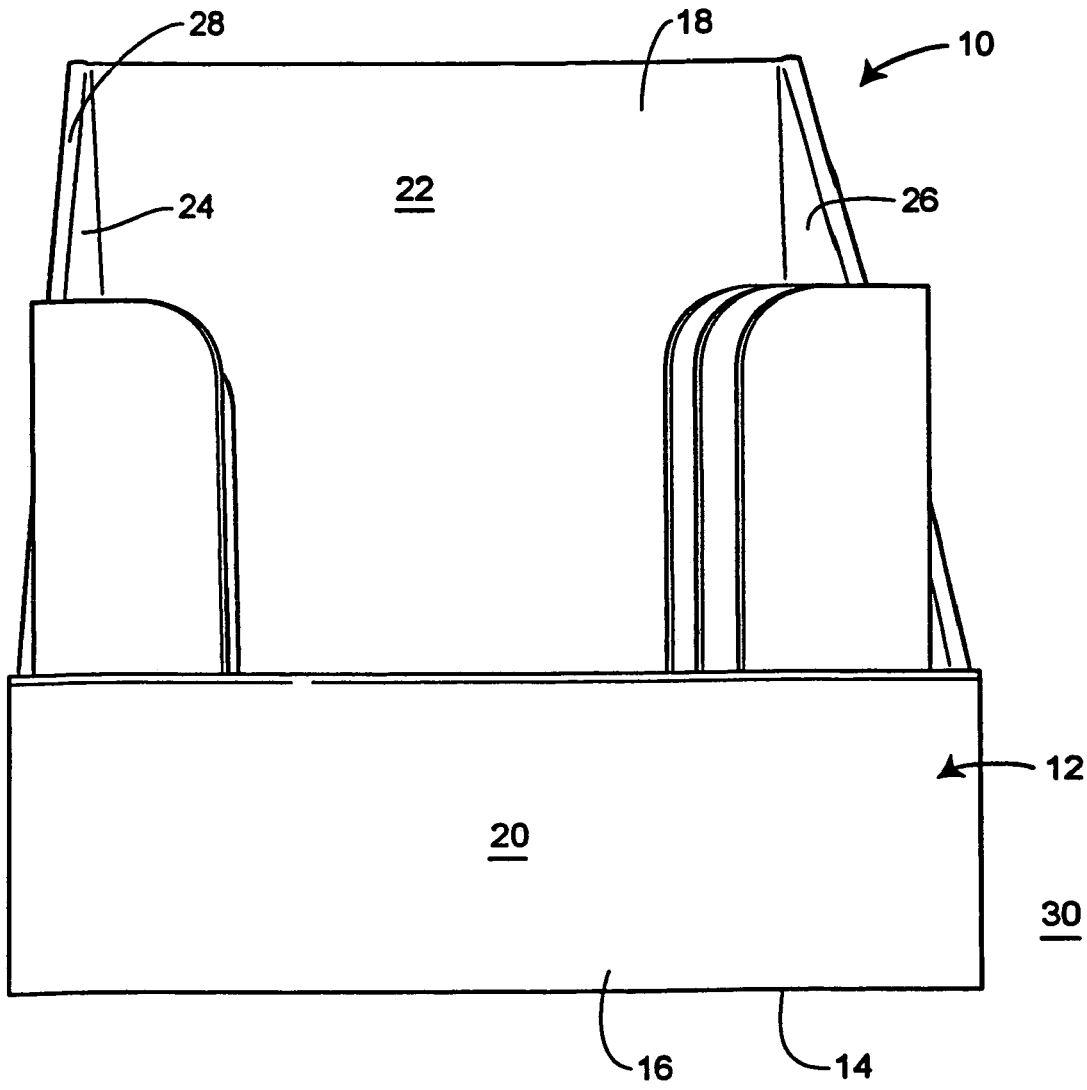
FIG. 2 is a front elevational view of the product display and support carton as illustrated in FIG. 1.

Referring to FIGS. 1 and 2, the front wall 20 comprises a product restraining rail of less than the height of the products to be displayed within the product receiving compartments such as 36 and 38 of the product carrying enclosure 18. On the other hand, the rear wall 22 opposite the front wall 20 comprises a product support panel of at least the height of the products to be displayed within the product receiving compartments such as 36 and 38 of the product carrying enclosure 18.

As will be appreciated from FIG. 4, the side walls 24 and 26 are vertical when the bottom panel 14 is on a horizontal surface such as 30 with the top wall panel edge 28 of the side walls 24 and 26 inclining upwardly and rearwardly from the front wall 20 to the rear wall 22. The dividers such as 32*a* and 34*a* each are parallel to the front and rear walls 20 and 22 in such a manner as to define upwardly and rearwardly inclined product receiving compartments 36 and 38 within the product carrying enclosure 18. Preferably, the carton 10 includes a plurality of carton inserts integrally associated with each of the side walls 24 and 26 within the product carrying enclosure 18 with each of the carton inserts having at least one divider corresponding to a divider on the other one of the side walls.

As shown in FIG. 4, the carton 10 advantageously includes carton inserts 40 and 42 and carton inserts 44 and 46, in addition to the previously discussed carton inserts 32 and 34. It will be understood that each of the carton inserts of at least one corresponding pair of the inserts, e.g., either inserts 32 and 34 or inserts 40 and 42 in the illustrated embodiment, are generally U-shaped. However, in the illustrated embodiment, the corresponding pair of inserts 32 and 34 and the corresponding pair of inserts 40 and 42 are both generally U-shaped.

Still referring to FIG. 4, each of the carton inserts of at least another corresponding pair, e.g., carton inserts 44 and 46, are generally L-shaped.

Figure 5:
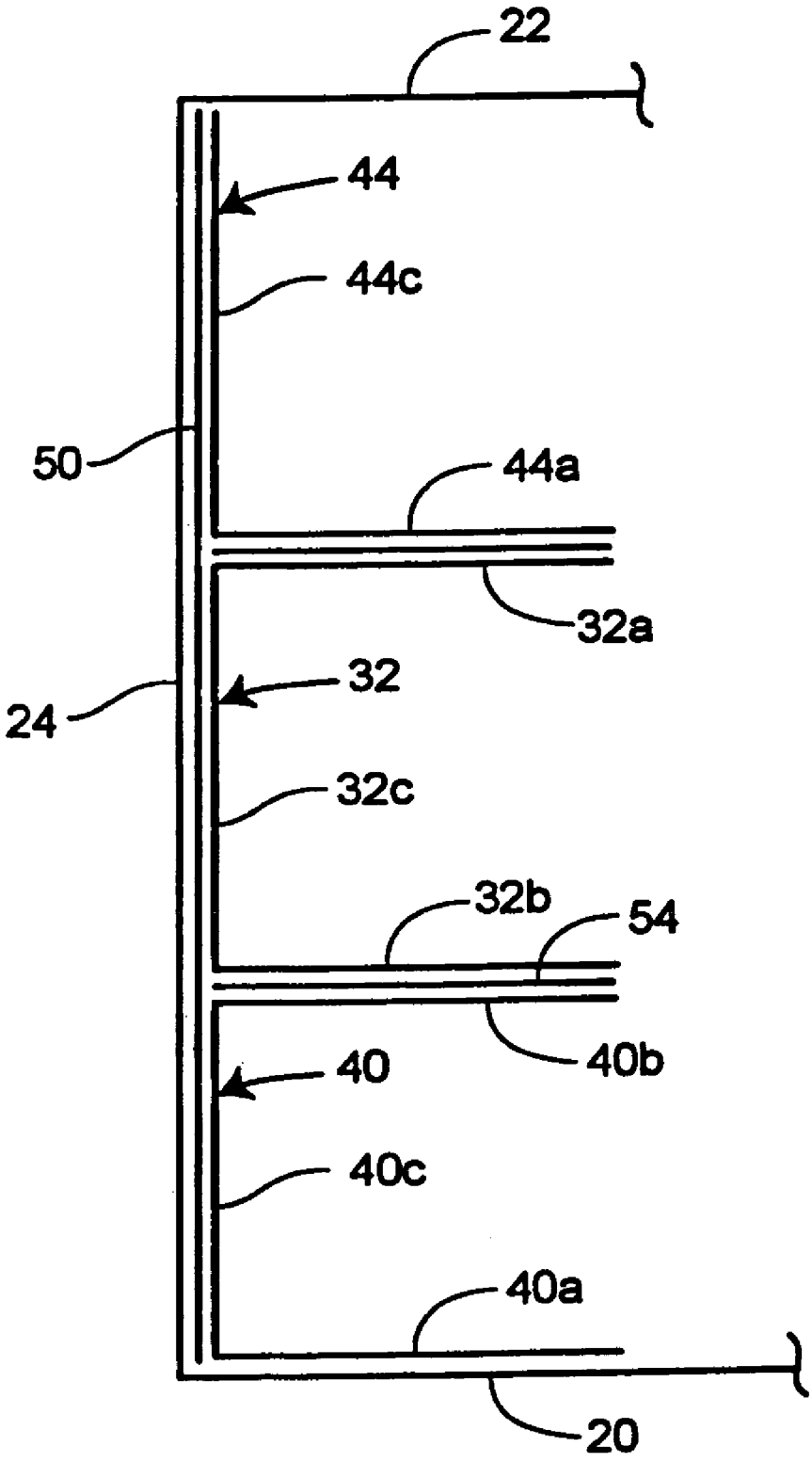
FIG. 5 is a cross-sectional view taken generally along the line 5-5 of FIG. 1.

In the illustrated embodiment, and as best illustrated in FIGS. 4 and 5, the generally U-shaped inserts 32, 34 and 40, 42 are both similarly constructed by having corresponding dividers. The inserts 32, 34 each have corresponding dividers 32*a*, 32*b* and 34*a*, 34*b* and the inserts 40, 42 each have corresponding dividers 40*a*, 40*b* and 42*a*, 42*b*. The generally U-shaped carton inserts 32, 34, 40, and 42 each have wall portions 32*c*, 34*c*, 40*c*, and 42*c* that join the corresponding dividers 32*a*, 32*b*; 34*a*, 34*b*; 40*a*, 40*b*; and 42*a*, 42*b*. The generally L-shaped carton inserts 44, 46 each include a single divider 44*a* and 46*a* joined to a wall portion 44*c* and 46*c* that extend completely to the rear wall 22 as shown in FIG. 4. With this arrangement, the pairs of carton inserts 32, 34; 40, 42; 44, and 46 define the previously described product receiving compartments 36 and 38 as well as the product receiving compartment 48.

Referring specifically to FIG. 5, each of the carton inserts such as 32, 40 and 44 are integrally associated with the corresponding side wall such as 24 of the display box 12 by being adhesively secured to the corresponding side wall such as 24 with double-sided tape as at 50. The carton inserts such as 32, 40 and 44 can be independent and applied to the inner surface of the side wall 24 with the double-sided tape 50 one-by-one or, preferably, they can be adhesively secured as at 52 and 54 (FIG. 5) thereby forming an integral insert by adhesively bonding the corresponding dividers 32*a* and 44*a* as well as adhesively bonding the corresponding dividers 32*b* and 40*b*. In this manner, the carton inserts 32, 40 and 44 may comprise a single insert to be adhesively secured by the double-sided tape as at 50 to the side wall 24 and the inserts 34, 42 and 46 can similarly form a single insert to be adhesively secured by double-sided tape to the side wall 26.

By using the double-sided tape to adhesively secure the carton inserts to the side walls, it is possible to greatly reduce the possibility that the inserts would pull away from the side walls during shipment or exposure to hot and cold weather extremes. It is, however, advantageous for the inserts to be adhesively secured together so as to form an integral assembly of inserts to be adhesively secured to the side wall 24 and to also form an integral assembly inserts to be adhesively secured to the side wall 26. Moreover, by forming the inserts to have a spacing between the dividers that is relatively limited, each of the product receiving compartments will hold a limited quantity of products such as gift bags.

By providing a limited quantity of products such as gift bags within each product receiving compartment, adequate support is provided for even a single gift bag that may remain in any one of the product receiving compartments.

Figure 6:
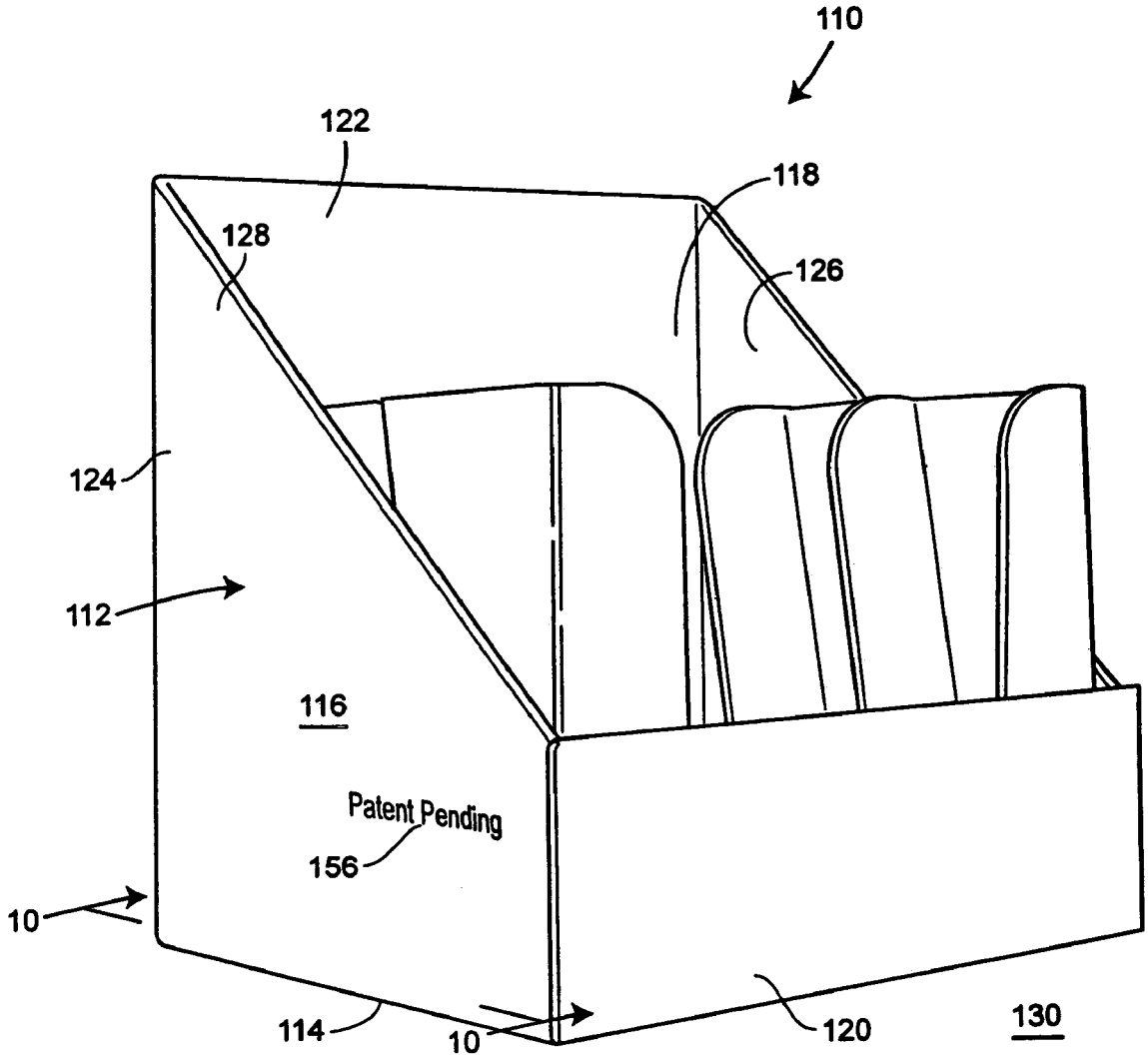
FIG. 6 is a perspective view of an alternate embodiment of a product display and support carton.

An alternate embodiment of a product display and support carton is shown in FIG. 6; the reference numeral 110 designates the product display and support carton. The carton 110 includes a display box, generally designated 112, defined by a bottom panel 114 and an upwardly extending wall panel 116 which together form a product carrying enclosure 118. The upwardly extending wall 116 is defined by an upwardly extending front wall 120, an upwardly extending rear wall 122, and a pair of generally parallel side walls 124 and 126. The front and rear walls 120, 122 are substantially perpendicular to the side walls 124, 126 and the bottom panel 114. The display box 112 has an open top defined by a top wall panel edge 128 of the front wall 120, rear wall 122, and side walls 124 and 126 which is located generally opposite the bottom panel 114. The carton 110 also includes a carton insert such as 132 and 134 in the product carrying enclosure 118 integrally associated with each of the side walls 124 and 126 (see FIG. 9). As will be appreciated from FIG. 9, the inserts 132 and 134 form and support one of a pair of opposed dividers such as 132*a* and 134*a* extending inwardly into the product carrying enclosure 118.

Figure 9:
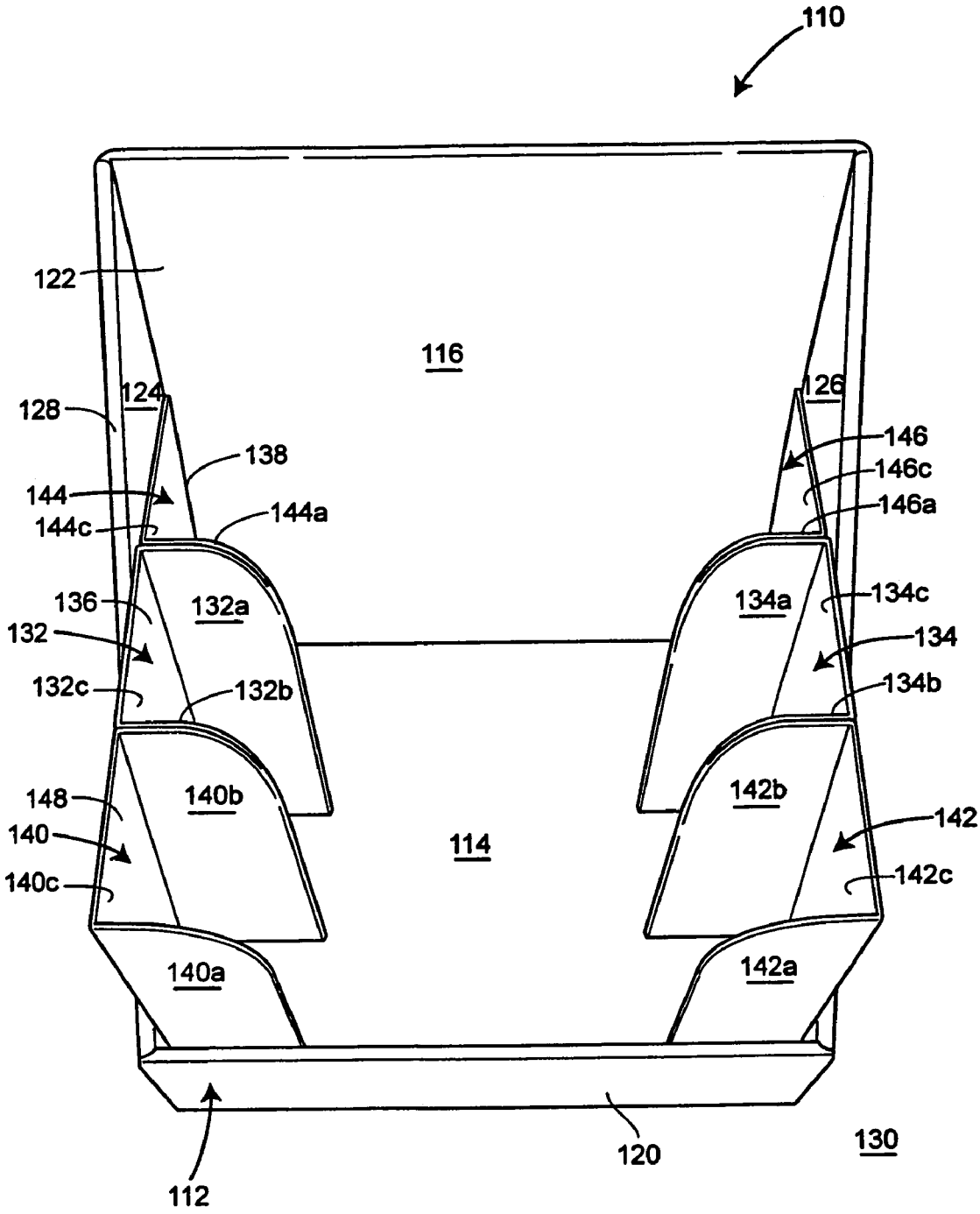
FIG. 9 is a top perspective view of the product display and support carton as illustrated in FIG. 6.

With reference still to FIG. 9, it will be seen that the inserts 132 and 134 with their dividers 132*b* and 134*b* define at least two separate product receiving compartments such as 136 and 140. At least one of the product receiving compartments 136, 140 generally has a cross-sectional area that is greater near the top wall panel edge 128 than near the bottom panel 114. In the embodiment of FIG. 9, the product receiving compartment 140 has a greater depth near the top wall panel edge 128 than near the bottom panel 114 because the dividers 132*a* and 132*b* are inclined generally towards the rear wall 116.

Figure 7:
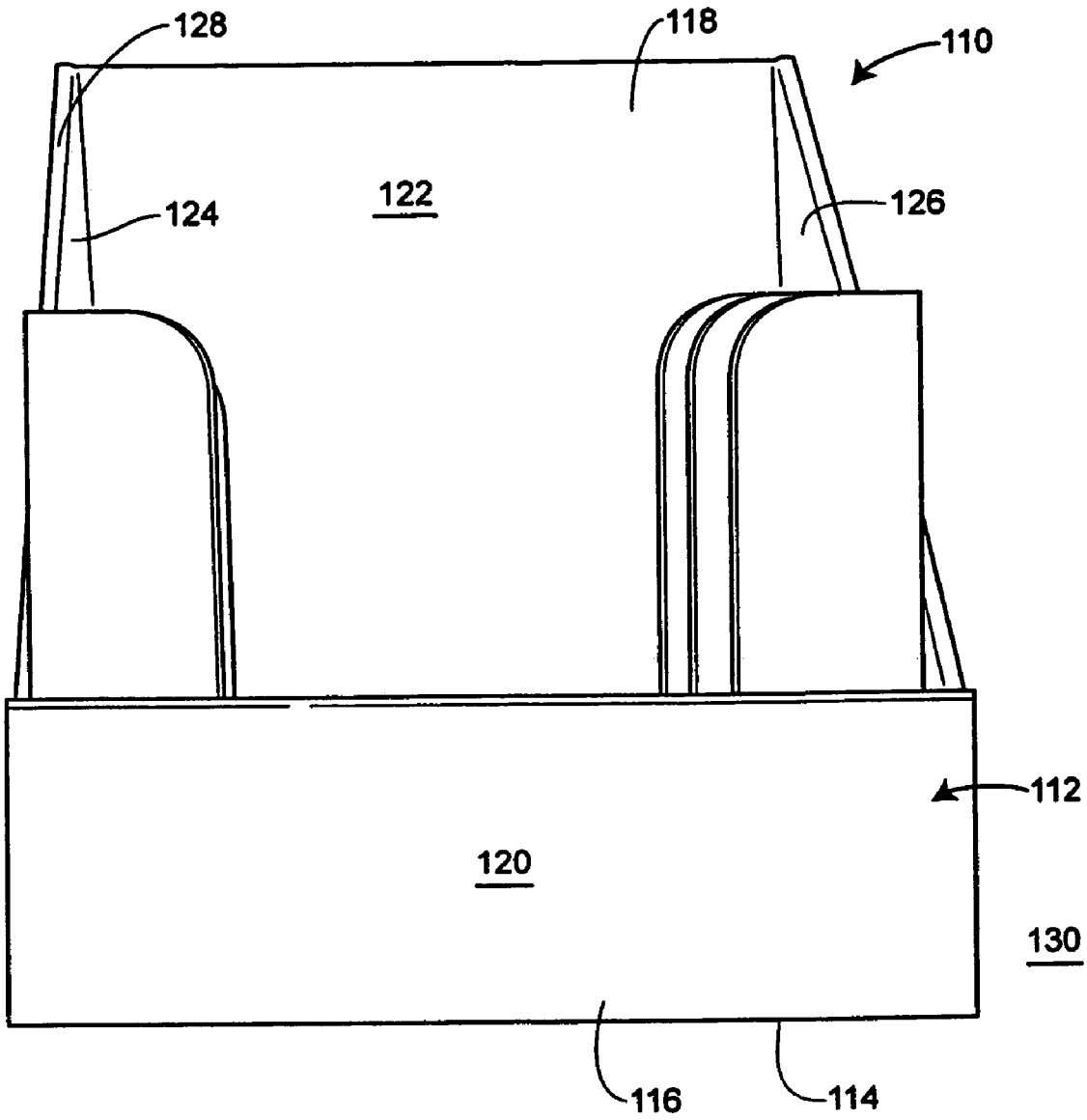
FIG. 7 is a front elevational view of the product display and support carton as illustrated in FIG. 6.
Figure 8:
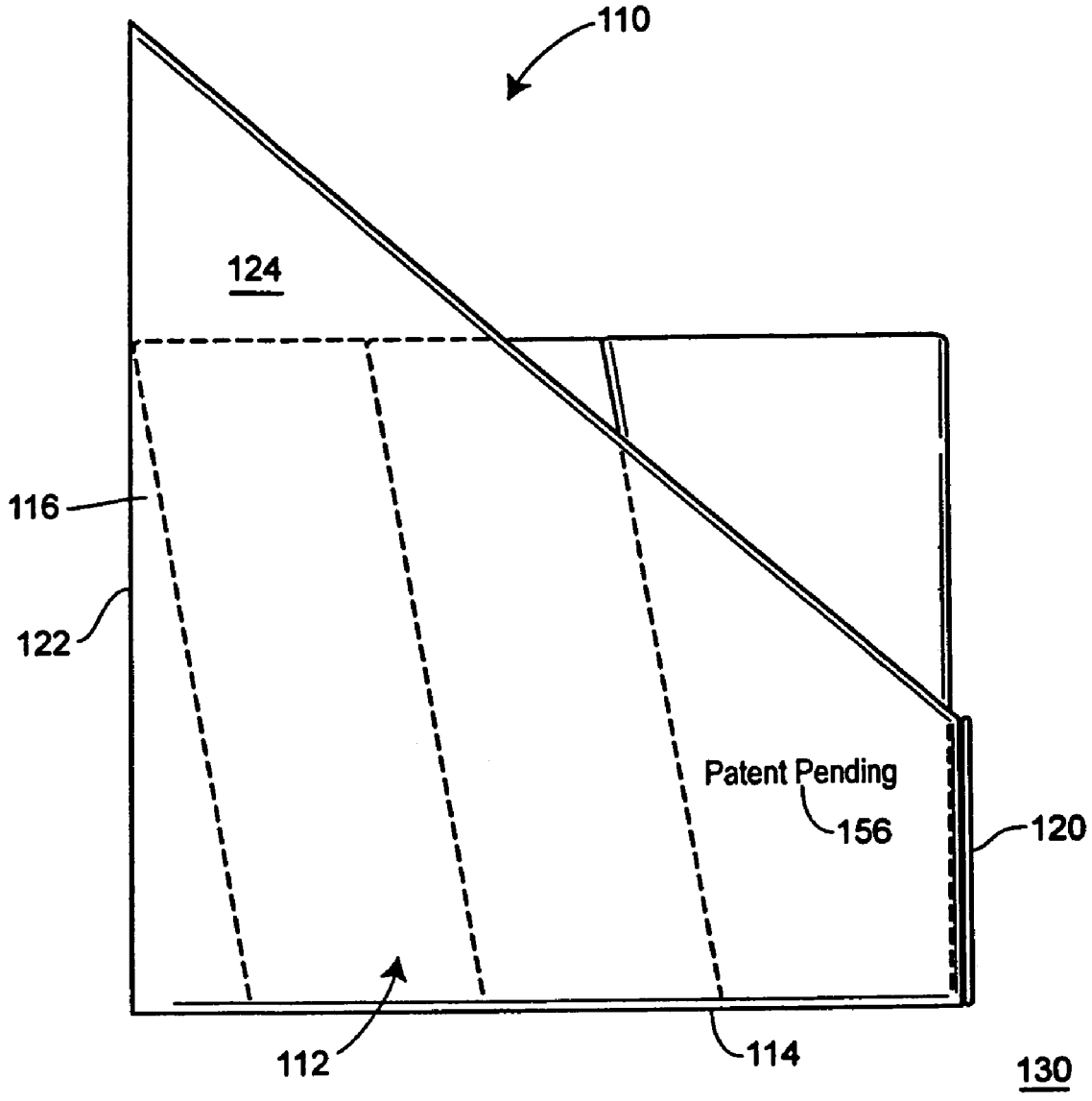
FIG. 8 is a side elevational view of the product display and support carton as illustrated in FIG. 6.

Referring to FIGS. 7 and 8, the front wall 120 comprises a product restraining rail of less than the height of the products to be displayed within the product receiving compartments such as 136, 138, 140 (See FIG. 9) of the product carrying enclosure 118. On the other hand, the rear wall 122 opposite the front wall 120 comprises a product support panel of at least the height of the products to be displayed within the product receiving compartments such as 136, 138 and 140 of the product carrying enclosure 118. However, the rear wall 122 may be shorter than the height of products to be displayed if desired.

As will be appreciated from FIG. 9, the side walls 124 and 126 are vertical when the bottom panel 114 is on a horizontal surface such as 130 with the top wall panel edge 128 of the side walls 124 and 126 inclining upwardly and rearwardly from the front wall 120 to the rear wall 122. The dividers such as 132*a* and 134*a* each are inclined with respect to the bottom panel 114 in such a manner as to define at least one product receiving compartment 136, 138, 140 that generally has a greater cross-sectional area near the top wall panel edge 128 than near the bottom panel 114. Preferably, the carton 110 includes a plurality of carton inserts integrally associated with each of the side walls 124 and 126 within the product carrying enclosure 118 with each of the carton inserts having at least one divider corresponding to a divider on the other one of the side walls. Further, the front most divider 140*a*, 142*a* is generally perpendicular to the bottom panel 114 and generally parallel to the front wall 120. This configuration facilitates attachment of the divider 140*a*, 142*a* to the front wall if desired and provides a guide surface for installation of a lid (not shown) for the carton 110.

As shown in FIG. 9, the carton 110 advantageously includes carton inserts 140 and 142 and carton inserts 144 and 146, in addition to the previously discussed carton inserts 132 and 134. It will be understood that each of the carton inserts of at least one corresponding pair of the inserts, e.g., either inserts 132 and 134 or inserts 140 and 142 in the illustrated embodiment, are generally U-shaped. However, in the illustrated embodiment, the corresponding pair of inserts 132 and 134 and the corresponding pair of inserts 140 and 142 are both generally U-shaped.

Still referring to FIG. 9, each of the carton inserts of at least another corresponding pair, e.g., carton inserts 144 and 146, are generally L-shaped.

Figure 10:
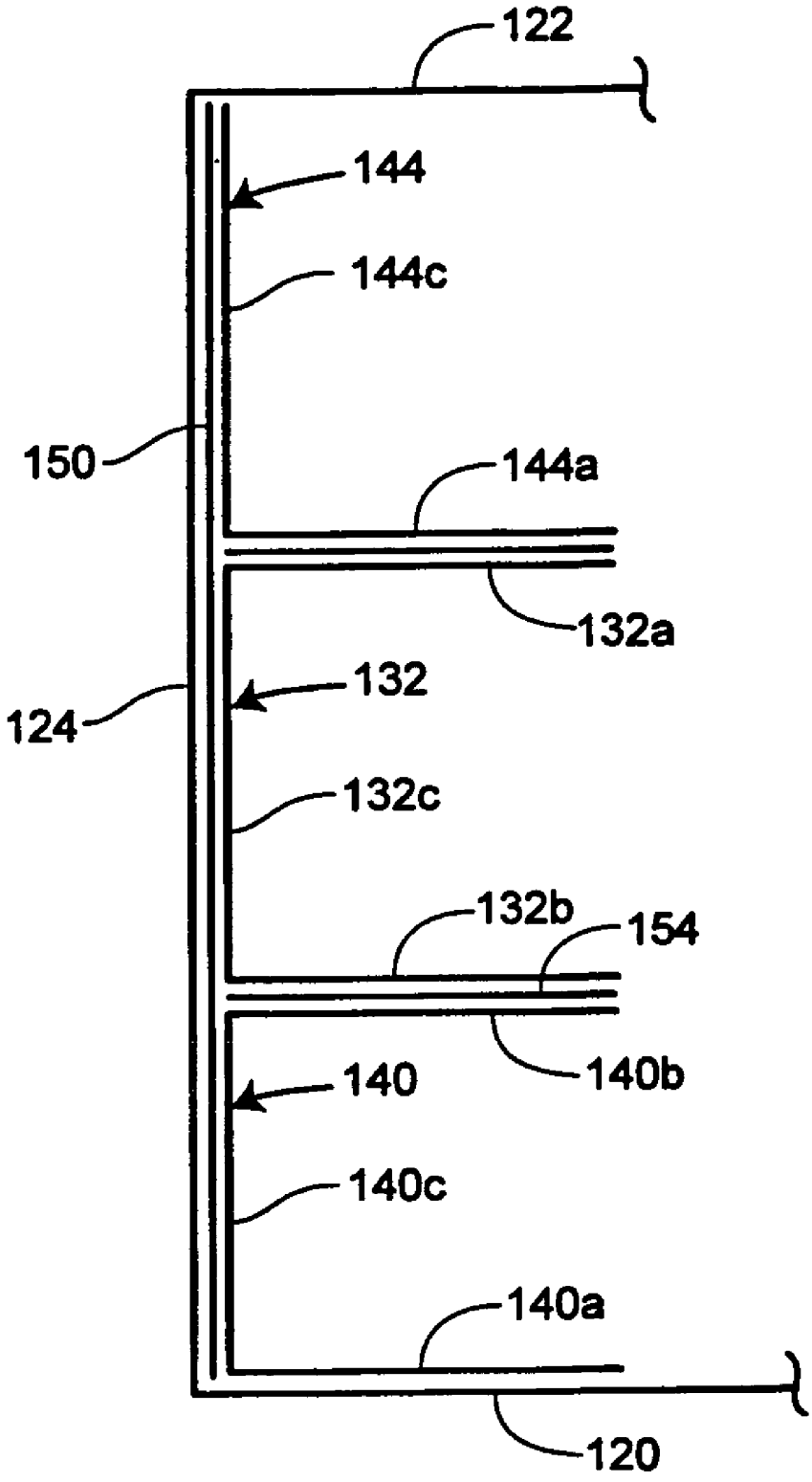
FIG. 10 is a cross-sectional view taken generally along the line 10-10 of FIG. 6.

As best illustrated in FIGS. 9 and 10, the generally U-shaped inserts 132, 134 and 140, 142 are both similarly constructed by having corresponding dividers. The inserts 132, 134 each have corresponding dividers 132*a*, 132*b* and 134*a*, 134*b* and the inserts 140, 142 each have corresponding dividers 140*a*, 140*b* and 142*a*, 142*b*. The generally U-shaped carton inserts 132, 134, 140, and 142 each have wall portions 132*c*, 134*c*, 140*c*, and 142*c* that join the corresponding dividers 132*a*, 132*b*; 134*a*, 134*b*; 140*a*, 140*b*; and 142*a*, 142*b*. The generally L-shaped carton inserts 144, 146 each include a single divider 144*a* and 146*a* joined to a wall portion 144*c* and 146*c* that extends toward the rear wall 122 as shown in FIG. 9. With this arrangement, the pairs of carton inserts 132, 134; 140, 142; 144, and 146 define the previously described product receiving compartments 136 and 138 as well as the product receiving compartment 148.

In this embodiment, the dividers 132*a*, 132*b* of insert 132 are generally parallel to one another, while the dividers 140*a*, 140*b* of insert 140 are generally angled relative to one another. Thus, the product receiving compartment 148 generally has a greater cross-sectional area near the top wall panel edge 128 than near the bottom panel 114. On the other hand, the product receiving compartment 136 is substantially the same cross-sectional area from top to bottom. Furthermore, the product receiving compartment 138 generally has a smaller cross-sectional area near the top wall panel edge 128 than near the bottom panel 114 because the divider 144*a* is angled relative to the rear wall 116.

Referring specifically to FIG. 10, each of the carton inserts such as 132, 140 and 144 are integrally associated with the corresponding side wall such as 124 of the display box 112 by being adhesively secured to the corresponding side wall such as 124 with double-sided tape as at 150. The carton inserts such as 132, 140 and 144 can be independent and applied to the inner surface of the side wall 124 with the double-sided tape 150 one-by-one or, preferably, they can be adhesively secured as at 152 and 154 (FIG. 10) thereby forming an integral insert by adhesively bonding the corresponding dividers 132*a* and 144*a* as well as adhesively bonding the corresponding dividers 132*b* and 140*b*. In this manner, the carton inserts 132, 140 and 144 may comprise a single insert to be adhesively secured by the double-sided tape as at 150 to the side wall 124 and the inserts 134, 142 and 146 can similarly form a single insert to be adhesively secured by double-sided tape to the side wall 126.

By using the double-sided tape to adhesively secure the carton inserts to the side walls, it is possible to greatly reduce the possibility that the inserts would pull away from the side walls during shipment or exposure to hot and cold weather extremes. It is, however, advantageous for the inserts to be adhesively secured together so as to form an integral assembly of inserts to be adhesively secured to the side wall 124 and to also form an integral assembly of inserts to be adhesively secured to the side wall 126. Moreover, by forming the inserts to have a spacing between the dividers that is relatively limited, each of the product receiving compartments will hold a limited quantity of products, such as gift bags, for example.

By providing a limited quantity of products such as gift bags within each product receiving compartment, adequate support is provided for even a single gift bag that may remain in any one of the product receiving compartments.

Finally, the display box and the carton inserts are all preferably formed of a corrugated material and the display box advantageously includes printed indicia as at 56, 156 (FIGS. 1 and 6) that may comprise product information, pricing, and other marketing material in the form of text or graphics.

While preferred embodiments of the invention have been set forth in detail in the forgoing description, it will be appreciated that the details herein given may be varied by those skilled in the art without departing from the true spirit and scope of the appended claims.

What is claimed is:

1. A product display and support carton, comprising:

a display box defined by a bottom panel and an upwardly extending wall panel together forming a product carrying enclosure, said display box having an open top defined by a top wall panel edge disposed opposite said bottom panel; and an opposed pair of dividers extending partially inwardly from opposite sides of said wall panel into said product carrying enclosure, said dividers extending toward one another to define a plurality of product receiving compartments and an unobstructed center view area for a product disposed in at least one of the product receiving compartments, wherein at least one of the product receiving compartments has a greater cross-sectional area near the top wall panel edge than near the bottom panel.

2. The product display and support carton of claim 1, wherein at least one of the product receiving compartments has a greater depth near the top wall panel edge than near the bottom panel.

3. The product display and support carton of claim 1, wherein at least one of the product receiving compartments has a smaller cross-sectional area near the top wall panel edge than near the bottom panel.

4. The product display and support carton of claim 1, wherein at least one of the product receiving compartments has substantially the same cross-sectional area from near the top wall panel edge to near the bottom panel.

5. The product display and support carton of claim 4 including a carton insert integrally associated with each of said side walls to thereby form and support one of said pair of dividers to define said at least two product receiving compartments.

6. The product display and support carton of claim 1 wherein said upwardly extending wall panel is defined by an upwardly extending front wall, an upwardly extending rear wall, and a pair of generally parallel side walls.

7. The product display and support carton of claim 6 wherein said front wall comprises a product restraining rail of less than the height of the products to be displayed within said product receiving compartments of said product carrying enclosure.

8. The product display and support carton of claim 6 wherein said rear wall comprises a product support panel of at least the height of the products to be displayed within said product receiving compartments of said product carrying enclosure.

9. The product display and support carton of claim 6 wherein said side walls are vertical when said bottom panel is on a horizontal surface, said top wall panel edge of said side walls inclining upwardly and rearwardly from said front to said rear wall.

10. The product display and support carton of claim 6 wherein said dividers each are inclined at an angle to said front and rear walls.

11. A product display and support carton, comprising:

a display box defined by a bottom panel and an upwardly extending wall panel together forming a product carrying enclosure, said upwardly extending wall panel being defined by an upwardly extending front wall, an upwardly extending rear wall, and a pair of generally parallel side walls, said display box having an open top defined by a top wall panel edge of said front wall, said rear wall, and said side walls located generally opposite said bottom panel; and a carton insert integrally associated with each of said side walls to form and support one of a pair of opposed dividers extending partially inwardly into said product carrying enclosure to define a plurality of product receiving compartments and an unobstructed center viewing area for a product disposed in at least one of the plurality of product receiving compartments, wherein at least one of the product receiving compartments has a greater cross-sectional area near the top wall panel edge than near the bottom panel.

12. The product display and support carton of claim 11 wherein said front wall comprises a product restraining rail of less than the height of the products to be displayed within said product receiving compartments of said product carrying enclosure.

13. The product display and support carton of claim 11 wherein said rear wall comprises a product support panel of at least the height of the products to be displayed within said product receiving compartments of said product carrying enclosure.

14. The product display and support carton of claim 11 wherein said side walls are vertical when said bottom panel is on a horizontal surface, said top wall panel edge of said side walls inclining upwardly and rearwardly from said front to said rear wall.

15. The product display and support carton of claim 11 wherein at least one divider is inclined at an angle with respect to the front and rear walls.

16. The product display and support carton of claim 15 including a plurality of carton inserts integrally associated with each of said side walls, each said carton insert having at least one divider corresponding to a divider on the other one of said side walls.

17. The product display and support carton of claim 16 wherein each of said carton inserts of at least one corresponding pair of said inserts integrally associated with said side walls to define one of said product receiving compartments are generally U-shaped.

18. The product display and support carton of claim 16 wherein each of said carton inserts of at least one corresponding pair of said inserts integrally associated with said side walls to define one of said product receiving compartments are generally L-shaped.

19. The product display and support carton of claim 16 wherein each of said cartons inserts is integrally associated with the corresponding side wall of said display box by being adhesively secured to the corresponding side wall with double-sided tape.

20. A gift bag display and support carton, comprising:

a display box defined by a bottom panel and an upwardly extending wall panel together forming a gift bag carrying enclosure, said upwardly extending wall panel being defined by an upwardly extending front wall, an upwardly extending rear wall, and a pair of generally parallel side walls, said display box having an open top defined by a top wall edge of said front wall, said rear wall, and said side walls located generally opposite said bottom panel; and a carton insert integrally associated with each of said side walls to form and support a first and second opposed dividers extending inwardly from opposite sides of said wall panel into said gift bag carrying enclosure to define at least two separate gift bag receiving compartments for receiving gift bags, the first divider is parallel to the second divider and both the first and second dividers are inclined at an angle to said front and rear walls;

said front wall comprising a gift bag restraining rail having a height less than the height of the gift bags to be displayed within said gift bag receiving compartments of said gift bag carrying enclosure, and said rear wall comprising a gift bag support panel.

21. The gift bag display and support carton of claim 20 wherein at least one of the gift bag receiving compartments has a greater cross-sectional area near the top wall edge than near the bottom panel within said gift bag enclosure.

22. The gift bag display and support carton of claim 21 including a plurality of carton inserts integrally associated with each of said side walls, each said carton insert having at least one divider corresponding to a divider on the other one of said side walls.

23. The gift bag display and support carton of claim 22 wherein each of said carton inserts of at least one corresponding pair of said inserts integrally associated with said side walls to define one of said gift bag receiving compartments are generally U-shaped.

24. The gift bag display and support carton of claim 22 wherein each of said carton inserts of at least one corresponding pair of said inserts integrally associated with said side walls to define one of said gift bag receiving compartments are generally L-shaped.

25. The gift bag display and support carton of claim 22 wherein each of said carton inserts is integrally associated with the corresponding side wall of said display box by being adhesively secured to the corresponding side wall with double-sided tape.

26. The gift bag display and support carton of claim 20 wherein said display box and said carton insert are both formed of a corrugated material and said display box includes printed indicia relating to purchasing gift bags contained within said gift bag carrying enclosure.

* * * * *